US006281129B1

(12) United States Patent
Easter et al.

(10) Patent No.: US 6,281,129 B1
(45) Date of Patent: Aug. 28, 2001

(54) CORROSION-RESISTANT POLISHING PAD CONDITIONER

(75) Inventors: William G. Easter; John A. Maze; Sailesh M. Merchant, all of Orlando, FL (US)

(73) Assignee: Agere Systems Guardian Corp., Orlando, FL (US)

( * ) Notice: Subject to any disclaimer, the term of this patent is extended or adjusted under 35 U.S.C. 154(b) by 0 days.

(21) Appl. No.: 09/399,621

(22) Filed: Sep. 20, 1999

(51) Int. Cl.[7] ..... H01L 21/302; H01L 21/461
(52) U.S. Cl. ..... 438/691; 438/692
(58) Field of Search ..... 438/691, 692, 438/693; 451/56, 72, 910; 427/249.8, 249.11, 249.12

(56) References Cited

U.S. PATENT DOCUMENTS 5,216,843 * 6/1993 Breivogel et al. ..... 51/131.1
5,485,804 * 1/1996 Adair et al. ..... 117/90
5,921,856 * 7/1999 Zimmer ..... 451/539
6,027,659 * 2/2000 Billett ..... 438/691
6,051,495 * 4/2000 Burke et al. ..... 438/692

* cited by examiner

*Primary Examiner*—Benjamin L. Utech
*Assistant Examiner*—Duy-Vu Deo

(57) ABSTRACT

The present invention provides a method of manufacturing a semiconductor device using a polishing apparatus having a polishing pad conditioning wheel. In one embodiment, the polishing pad conditioning wheel comprises a conditioning head, a setting alloy, an abrasive material, and a corrosion resistant coating. The conditioning head has opposing first and second faces with the first face being coupleable to the polishing apparatus. The setting alloy is coupled to the conditioning head at the second face, and the abrasive material is embedded in the setting alloy, which is substantially covered by the corrosion resistant coating.

9 Claims, 2 Drawing Sheets

CORROSION-RESISTANT POLISHING PAD CONDITIONER

TECHNICAL FIELD OF THE INVENTION

The present invention is directed, in general, to a semiconductor wafer polishing apparatus and, more specifically, to a polishing pad conditioner having improved corrosion resistance against the chemicals of a chemical/mechanical planarization process.

BACKGROUND OF THE INVENTION

Chemical mechanical planarization (CMP) is an essential process in the manufacture of semiconductor chips today. Dielectric and metal layers used in chip fabrication must be made extremely flat and of precise thickness in order to pattern the sub-micron sized features that comprise a semiconductor device. During CMP, the combination of chemical etching and mechanical abrasion produces the required flat, precise surface for subsequent depositions. The polishing pad is usually made of polyurethane and has small pores to carry the slurry under the wafer. As a result of the polishing process, pad material and slurry residues collect in the pores, plugging them, and reducing the polish rate due to slurry starvation. When the pad becomes clogged, it becomes necessary to "condition" the pad to restore its full functionality. That is, the accumulated material must be removed before it completely clogs the pad and results in a smooth, glazed surface that does not effectively polish the semiconductor wafer. A nickel/chromium conditioning wheel with a surface of diamond abrasives embedded in a nickel/chromium setting alloy is used to condition the pad. The conditioning wheel is pressed against the polishing pad by a conditioning wheel actuator, e.g., a hydraulic arm, and the pad and conditioning wheel are rotated while de-ionized water is flowed to rinse away abraded material. The diamond elements remove embedded particles, slurry, and polishing by-products from the polishing pad. The conditioning proceeds until the pad is "re-surfaced" and new pores are exposed.

As the conditioning wheel is rotated against the polishing pad, the wheel, setting alloy, and the diamonds come in contact with the chemical/mechanical slurry. Conventional conditioners for an oxide polisher have useable lifetime of about 15,000 wafers. On the other hand, conventional conditioners for a tungsten metal polisher have a useable lifetime of only about 5,000 to 7,000 wafers. While nickel/chromium is generally considered a chemically-resistant alloy, the slurries used to planarize metal layers, especially tungsten, are very corrosive. As a consequence, the chemicals of the slurry attack the nickel/chromium setting alloy and, over time, loosen the diamond crystals, causing them to fall out of the polishing surface. Of course, this reduces the effective surface area of the conditioning wheel and slows the conditioning process.

Accordingly, what is needed in the art is a conditioning wheel that is highly resistive to the effects of the corrosive oxidants primarily found in metal polishing slurries.

SUMMARY OF THE INVENTION

To address the above-discussed deficiencies of the prior art, the present invention provides a method of manufacturing a semiconductor device using a polishing apparatus having a polishing pad conditioning wheel. In one embodiment, the polishing pad conditioning wheel comprises a conditioning head, a setting alloy, an abrasive material, and a corrosion resistant coating. The conditioning head has opposing first and second faces with the first face being coupleable to the polishing apparatus. The setting alloy is coupled to the conditioning head at the second face, and the abrasive material is embedded in the setting alloy, which is substantially covered by the corrosion resistant coating.

Thus, in a broad scope, the present invention provides a protective, corrosion-resistant coating on otherwise corrosion-vulnerable setting alloys. As a consequence, the setting alloys are better protected by the corrosion-resistant coating and its oxidized by-products so that the integrity of the corrosion-resistant coating is not jeopardized, which would ultimately result in dislodging of the abrasive material. While the discussion regarding the present invention is directly oriented toward preventing the deleterious effects of metal polishing slurries, it should be readily apparent to one who is skilled in the art that the invention is equally applicable to other, less damaging, polishing slurries.

In one particularly advantageous embodiment, the corrosion resistant coating is a chromium/aluminum/yttrium alloy. In one aspect of this particular embodiment, the chromium/aluminum/yttrium alloy may be either a nickel/chromium/aluminum/yttrium alloy or a cobalt/chromium/aluminum/yttrium alloy. The coating is highly corrosion and oxidation resistant.

The setting alloy is preferably a hard facing metal alloy, such as a nickel/chromium/iron alloy. Example of some suitable hard facing metal alloys are: Inconel® 718, Inconel® 718 LC, Hastelloy®, and Illium-R®. Other useable hard facing alloys of well known stainless steels (SS) include: 309 SS, 347 SS, 430 SS, and 18-8 stainless steel. In one particular embodiment, the corrosion resistant coating is highly adherent to the setting alloy.

The abrasives employed in the present invention are well known to those who are skilled in the art and include abrasives, such as diamonds. Other abrasives typically used on conditioning rings, however, are also within the scope of the present invention.

The foregoing has outlined, rather broadly, preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the invention in its broadest form.

BRIEF DESCRIPTION OF THE DRAWINGS

For a more complete understanding of the present invention, reference is now made to the following descriptions taken in conjunction with the accompanying drawings, in which.

DETAILED DESCRIPTION

Figure 1:
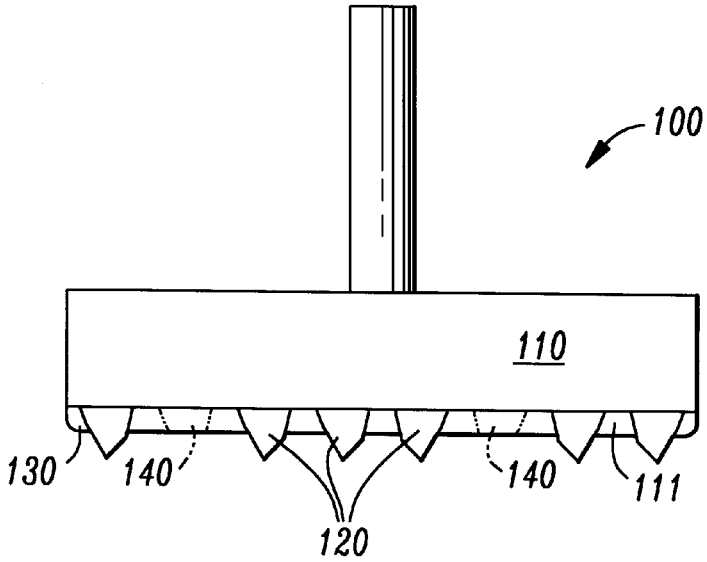
FIG. 1 (PRIOR ART)
FIG. 1 illustrates a sectional view of a conventional semiconductor polishing pad conditioning head.

Referring initially to FIG. 1, illustrated is a sectional view of a conventional semiconductor polishing pad conditioning head 100. The conventional semiconductor polishing pad conditioning head 100 comprises a conditioning head 110, abrasive crystals 120, and a setting alloy 130. The setting alloy 130 is coupled to the conditioning head 110 and holds the abrasive crystals 120 in place on a face 111 of the conditioning head 110. In a typical conventional embodiment, the abrasive crystals are diamond crystals. During conditioning, the setting alloy 130 comes in contact with oxidizers remaining from polishing metal, e.g., tungsten, layers of semiconductor wafers. The corrosive effects of the strong oxidizers needed for tungsten CMP erodes the setting alloy 130 and causes diamond crystals 120 to fall from the setting alloy 130 as shown at locations 140.

Figure 2:
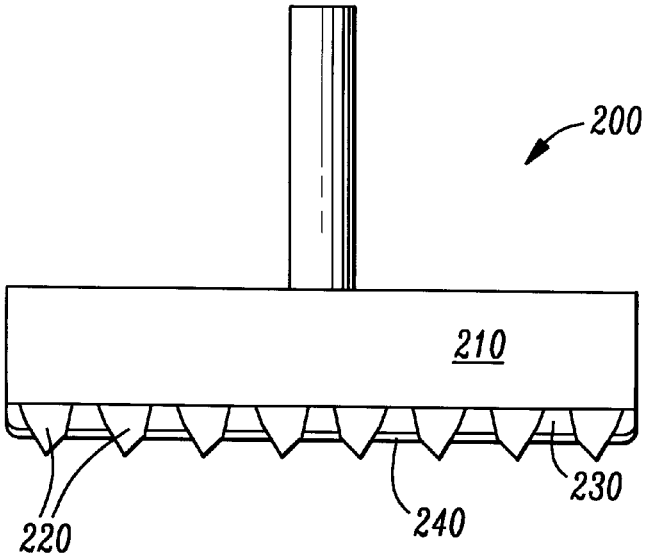
FIG. 2 illustrates a sectional view of one embodiment of a semiconductor polishing pad conditioning head constructed according to the principles of the present invention.

Referring now to FIG. 2, illustrated is a sectional view of one embodiment of a semiconductor polishing pad conditioning head 200 constructed according to the principles of the present invention. The semiconductor polishing pad conditioning head 200 comprises a conditioning head 210, abrasive crystals 220, a setting alloy 230, and a corrosion-resistant coating 240 located over the setting alloy 230. In one embodiment, the setting alloy 130 is a hard facing metal alloy, e.g., a nickel/chromium/iron alloy. In one advantageous embodiment, the abrasive crystals are diamonds. Of course, one who is skilled in the art will recognize that abrasive crystals other than diamonds may also be used.

In one embodiment, the setting alloy 230 is preferably a hard-facing alloy, such as a nickel/chromium/iron alloy. However, in other embodiments, the setting alloy 230 may be a hard-facing alloy such as stainless steel. Commonly known stainless steels (SS) that may be used in the present invention may include: 309 SS, 347 SS, 430 SS, or 18-8 SS. Alternatively, the setting alloy 230 may comprise commercially available alloys such as: Inconel® 718, Inconel® 718 LC, Hastelloy®, or Illium-R®. In one particularly advantageous embodiment, the corrosion-resistant coating 240 comprises a chromium/aluminum/yttrium alloy. Specific alternative embodiments of the corrosion-resistant coating 240 include nickel/chromium/aluminum/yttrium or cobalt/chromium/aluminum/yttrium alloys.

Figure 3:
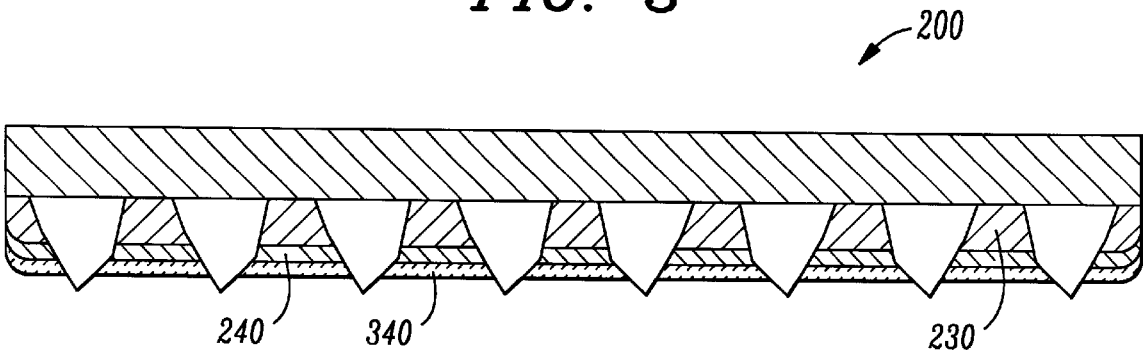
FIG. 3 illustrates a sectional view of the polishing pad conditioning head of FIG. 2 following exposure to an oxidizing environment.

Referring now to FIG. 3, illustrated is an enlarged sectional view of the polishing pad conditioning head 200 of FIG. 2 following exposure to an oxidizing environment. When the polishing pad conditioning head 200 is exposed to oxidizing conditions during conditioning of a metal-polishing pad, it is believed that yttrium disperses and aides in pinning the grain boundaries in the corrosion-resistant coating 240, while the aluminum and chromium of the corrosion-resistant coating 240 form their respective oxides, e.g., $Al_2O_3$, $Cr_2O_3$, etc. Because of the yttrium dispersion, the oxides are able to form an adherent oxide layer 340 on the corrosion-resistant coating 240. This oxide layer 340, therefore, enables the setting alloy 230 to resist corrosion better than a conventional configuration of a bare setting alloy 130 as described in FIG. 1, and thereby improve the useable lifetime of the conditioning head 200.

Figure 4:
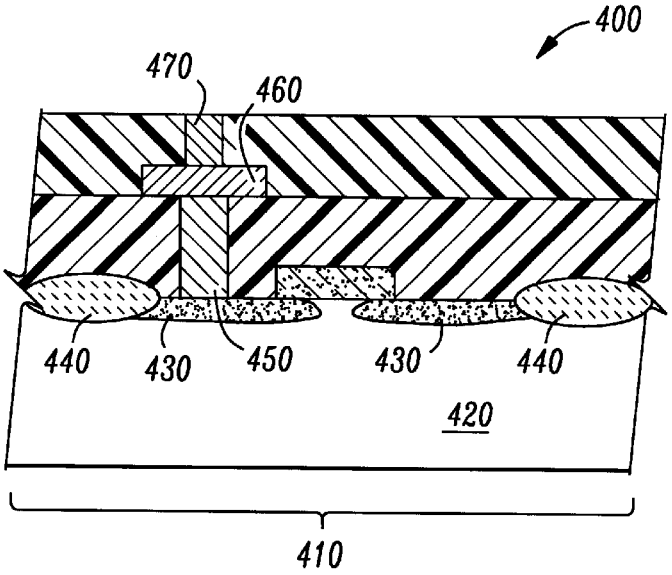
FIG. 4 illustrates a partial sectional view of a conventional integrated circuit that can be manufactured using a polishing pad conditioning wheel constructed in accordance with the principles of the present invention.

Referring now to FIG. 4, illustrated is a partial sectional view of a conventional integrated circuit 400 that can be manufactured using a polishing pad conditioning wheel constructed in accordance with the principles of the present invention. In this particular sectional view, there is illustrated ah active device 410 that comprises a tub region 420, source/drain regions 430 and field oxides 440, which together may form a conventional transistor, such as a CMOS, PMOS, NMOS or bi-polar transistor. A contact plug 450 contacts the active device 410. The contact plug 450 is, in turn, contacted by a trace 460 that connects to other regions of the integrated circuit, which are not shown. A VIA 470 contacts the trace 460, which provides electrical connection to subsequent levels of the integrated circuit.

Although the present invention has been described in detail, those skilled in the art should understand that they can make various changes, substitutions and alterations herein without departing from the spirit and scope of the invention in its broadest form.

What is claimed is:

1. A method of manufacturing a semiconductor device, comprising:

polishing a semiconductor wafer with a chemical/mechanical slurry against a polishing pad, the polishing forming variations in a polishing surface of the polishing pad; and conditioning the polishing surface with a polishing pad conditioning wheel comprising:

a conditioning head having opposing first and second faces, the first face coupleable to a polishing apparatus;

a setting alloy coupled to the conditioning head at the second face;

abrasive material embedded in the setting alloy; and a corrosion resistant coating affixed to the setting alloy.

2. The method as recited in claim 1 wherein conditioning includes conditioning with a polishing pad conditioning wheel wherein the corrosion resistant coating comprises a chromium/aluminum/yttrium alloy.

3. The method as recited in claim 2 wherein conditioning includes conditioning with a polishing pad conditioning wheel wherein the chromium/aluminum/yttrium alloy comprises a nickel/chromium/aluminum/yttrium alloy.

4. The method as recited in claim 2 wherein conditioning includes conditioning with a polishing pad conditioning wheel wherein the chromium/aluminum/yttrium alloy comprises a cobalt/chromium/aluminum/yttrium alloy.

5. The method as recited in claim 1 wherein conditioning includes conditioning with a polishing pad conditioning wheel wherein the setting alloy comprises a hard facing metal alloy.

6. The method as recited in claim 5 wherein conditioning includes conditioning with a polishing pad conditioning wheel wherein the setting alloy comprises a nickel/chromium/iron alloy.

7. The method as recited in claim 5 wherein conditioning includes conditioning with a polishing pad conditioning wheel wherein the hard facing metal alloy is selected from the group consisting of:

Inconel® 718,

Inconel® 718 LC,

Hastelloy®,

Illium-R®,

309 Stainless Steel,

347 Stainless Steel,

430 Stainless Steel, and 18-8 Stainless Steel.

8. The method as recited in claim 1 wherein conditioning includes conditioning with an abrasive material comprising diamonds.

9. A method for manufacturing an integrated circuit, comprising:

forming active devices on a semiconductor wafer and forming a substrate over the active devices;

positioning a semiconductor wafer in a polishing apparatus having a polishing surface, the polishing surface having been conditioned with a polishing pad conditioning wheel comprising:

a conditioning head having opposing first and second faces, the first face coupleable to the polishing apparatus;

a setting alloy coupled to the conditioning head at the second face;

abrasive material embedded in the setting alloy; and a corrosion resistant coating affixed to the setting alloy; and polishing the substrate against the polishing surface using the slurry.

* * * * *